United States Patent [19]

Bonomi

[11] 4,236,450

[45] Dec. 2, 1980

[54] INSTALLATION FOR THE CONTINUOUS CLEANING OF A WIPING ROLLER OF A MACHINE FOR COPPER-PLATE PRINTING

[75] Inventor: Antonio Bonomi, Lausanne, Switzerland

[73] Assignee: De La Rue Giori S.A., Lausanne, Switzerland

[21] Appl. No.: 831,916

[22] Filed: Sep. 9, 1977

[30] Foreign Application Priority Data

Sep. 17, 1976 [CH] Switzerland ..... 11801/76

[51] Int. Cl.[3] ..... B41F 35/00

[52] U.S. Cl. ..... 101/425; 101/169; 15/256.51; 134/104

[58] Field of Search ..... 101/425, 166, 167, 168, 101/169; 15/256.51; 134/104

[56] References Cited

U.S. PATENT DOCUMENTS

| | | | |
|---|---|---|---|
| Re. 17,275 | 4/1929 | Schultz | 101/425 |
| 2,659,305 | 11/1953 | Giori | 101/423 |
| 3,580,261 | 5/1971 | Key | 134/104 |
| 3,656,431 | 4/1972 | Giori | 101/425 |
| 3,737,940 | 6/1973 | Moestne et al. | 101/425 |
| 3,789,860 | 2/1974 | Katterheinrich et al. | 134/104 |
| 3,896,730 | 7/1975 | Garrett et al. | 101/425 |
| 3,952,650 | 4/1976 | Lott | 101/425 |
| 4,135,530 | 1/1979 | Cheney | 134/104 |

*Primary Examiner*—William Pieprz

*Attorney, Agent, or Firm*—Robert E. Burns; Emmanuel J. Lobato; Bruce L. Adams

[57] ABSTRACT

A cleaning device for a wiping cylinder of a direct plate printing machine, comprising a container for receiving the cleaner liquid, a first scraper in contact with the periphery of the wiping cylinder followed by brushes and further scrapers, at least two rows of nozzles parallel with the axis of the wiping cylinder for ejecting the cleaning liquid such that in the direction of rotation of the cylinder, the area of the wiping cylinder located in front of said scrapers and brushes being wetted by a continuous film of liquid, the level of liquid in the container being kept such that the wiping roller is never immersed in said liquid.

8 Claims, 3 Drawing Figures

INSTALLATION FOR THE CONTINUOUS CLEANING OF A WIPING ROLLER OF A MACHINE FOR COPPER-PLATE PRINTING

BACKGROUND OF THE INVENTION

The present invention relates to an installation for the continuous cleaning of a wiping roller of a machine for direct plate or copper-plate printing in one or more coulours, comprising a container for receiving the cleaning liquid which acts permanently on the wiping roller and cleaning members in contact with the periphery of the wiping roller comprising, in the direction of rotation of this roller, a first scraper constituting the first cleaning member, followed at fixed distances by several other members constituted by brushes and/or scrapers.

An installation is already known in which the wiping roller is immersed in the cleaning liquid contained in a reservoir, this installation comprising a first scraper forming an acute angle with the peripheral segment of the wiping roller and after this first scraper, in the direction of rotation of the wiping roller, several other scrapers and at least one fixed brush which are located in the humidification zone.

This installation which makes it possible to use an alkaline aqueous solution as the cleaning liquid, gives good results as regards the cleaning efficiency of the wiping roller, however, this design always requires an interruption of the operation of the installation for renewing the solution of the cleaning bath.

Hitherto, it has always been considered useful and necessary that the wiping roller is partly immersed in the cleaning bath. It was therefore very important that the cleaning bath be renewed completely as soon as it was full of small particles of ink in suspension, in order to eliminate the danger of these particles of ink being re-deposited on the surface of the roller. This required frequent interruptions in the operation of the installation.

Even if, with this type of known installation, it was envisaged to re-generate the solution by a closed circuit system, a time always comes, or after a certain operating time, the solution becomes dirty, spent and it is therefore necessary to stop the operation of the installation in order to empty the reservoir and clean its walls. This momentary stoppage of operation of the installation is always troublesome, since it reduces production, thus wasting a considerable amount of time.

The fact of using such a bath of cleaning liquid which becomes dirty slowly, has the drawback that the quality of printing generally undergoes a certain fluctuation in the course of an operating cycle of the installation, this quality of printing becomes worse and worse as the solution becomes dirty and, even by stopping the operation of the installation in order to renew the bath, it is not possible to avoid the fact that the quality of printing, which is excellent when the cleaning liquid has been renewed, gradually deteriorates. This fluctuation in the quality of printing is inadmissible when printing paper currency, in particular bank notes and in order to reduce this fluctuation in the quality to a maximum, it is necessary to interrupt the operation of the machine very frequently, in order to renew the solution.

With rotary printing machines having a high rotary speed, which are used at the present time, it may be necessary to interrupt operation of the machine every hour for approximately 15 minutes in order to renew the bath.

In fact, it is very important that this replacement of the used solution is carried out in good time, before any stain is produced on the wiping roller and is transferred to the sheet to be printed.

SUMMARY OF THE INVENTION

The present invention proposes to obviate the above-mentioned drawbacks inherent in the necessity of stopping the operation of the machine for replacement of the cleaning bath, whilst making it possible to obtain the same quality of printing throughout the entire operation of the printing machine.

To this end, the installation according to the invention is characterised by the fact that at least two rows of nozzles parallel to the axis of the wiping roller are provided, for ejecting the cleaning liquid, the arrangement of these nozzles and the direction of their orifices being such that in the direction of rotation of the roller, the area of the wiping roller located in front of the region of contact with said roller of the scraper constituting the first cleaning member and that of the second cleaning member is wetted by a continuous film of liquid and that the level of the cleaning liquid in the container is kept at a height such that the wiping roller is never in contact with the liquid in the container.

Due to these measures, the area of contact with the wiping roller of the two first cleaning members at least is suitably wetted with a continuous film of liquid and of a constant quality, which makes it possible to obtain a uniform quality of printing of the bank notes.

One thus eliminates the drawback that the wiping roller is immersed in a solution which becomes increasingly dirty during cleaning. The cleaning solution is constantly renewed and is sprayed through the nozzles directly onto the surface of the roller in the region of contact of the scrapers or brushes, which facilitates efficient cleaning.

Experience has shown that it is now possible to obtain an impeccable and uniform quality of printing, without interrupting the operation of the installation, with modern machines whose plate-support cylinder reaches speeds of 2,000 to 2,500 revolutions per hour, i.e. if the cylinder carries four copper-plate printing plates with a machine capacity of 8,000 to 8,800 sheets per hour.

This installation is even advantageous compared with a cleaning installation in which the solution is re-cycled and re-generated in a closed circuit, since a re-cycled installation of this type is expensive and also very bulky.

It is preferable to provide a row of nozzles associated with each cleaning member in order that the areas of the wiping roller located in front of the region of contact of each cleaning member are wetted sufficiently.

In view of the fact that the first scraper which normally forms an acute angle with the periphery of the roller located after this scraper, in the direction of rotation of said roller, generally removes more than 90% of the ink sticking to the surface of this roller, it has been found that it was preferable to have a jet of water directed towards the region of contact of this scraper, on the rear side of the latter, this jet having to be sufficiently strong in order to prevent any danger of an accumulation of ink in this acute angle, in the long term.

This is why, according to a preferred embodiment of the invention, a second row of nozzles located behind the first scraper is provided, in the direction of rotation of the wiping roller, the orifices of these nozzles being directed inside said acute angle.

It is also advantageous that this second row of nozzles is supplied with a solution having a rate of flow and pressure greater than those necessary for the other rows. As regards the latter, it is sufficient to have good wetting in front of the region of contact of each cleaning member, with a liquid pressure which is not very high, for example of the order of 4 bars. However, for this second row of nozzles, it is useful to have a high pressure and rate of flow. To make the best use of the clean solution, taking into account the above-mentioned preferred conditions, in order to supply this second row of nozzles, it is possible to re-utilise the used solution coming from the other rows of nozzles.

BRIEF DESCRIPTION OF THE DRAWINGS

The accompanying drawings illustrate one embodiment of the invention, by way of example.

DESCRIPTION OF THE PREFERRED EMBODIMENT

Figure 1:
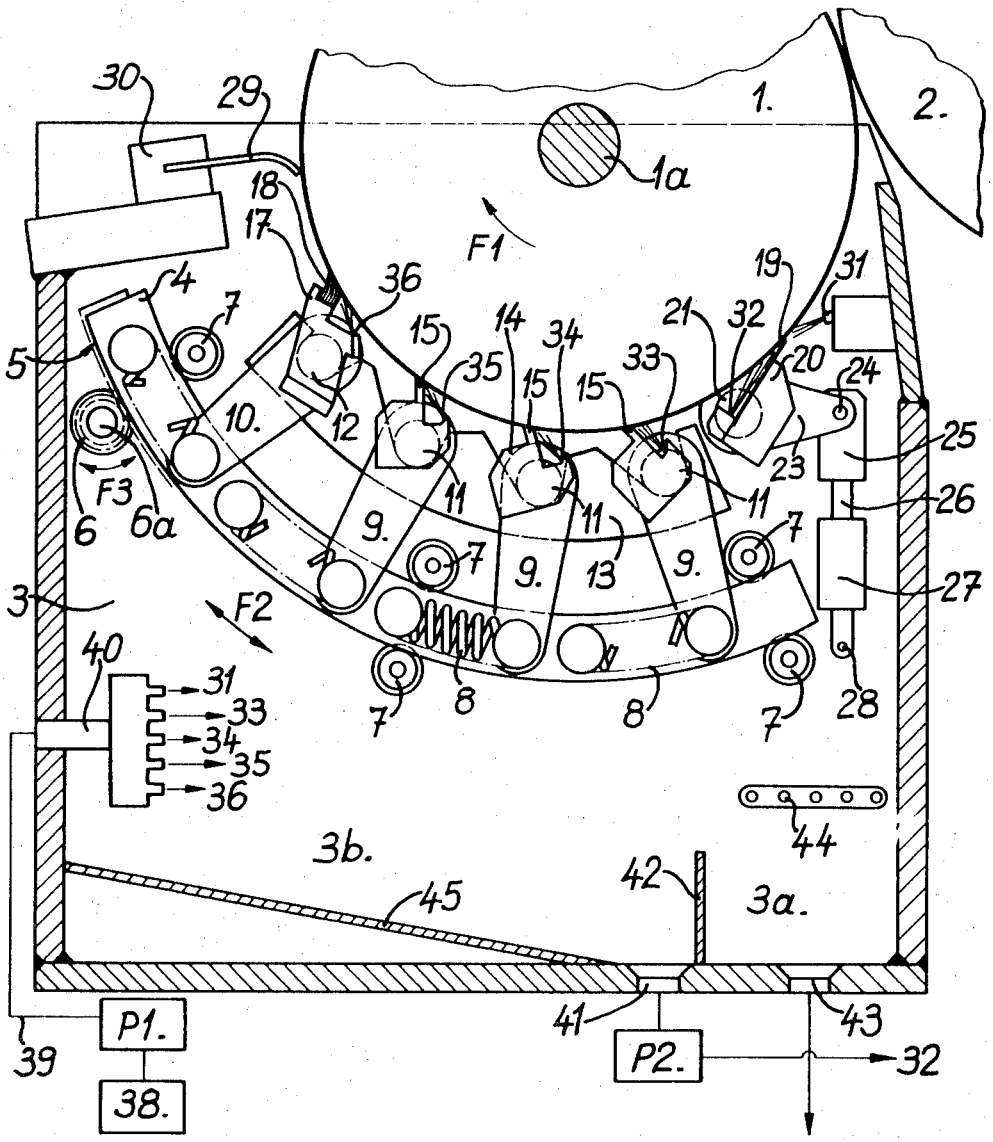
FIG. 1 is a diagrammatic view of an installation in side elevation, partly in section, embodying the invention.

A wiping roller 1 rotating about a shaft 1*a* in the direction of arrow F1 and in contact with a plate-support cylinder 2 supporting the printing plates, is located partly inside a container 3 in which the installation for cleaning the wiping roller is mounted.

This cleaning installation comprises, on the one hand, in known manner, several cleaning members constituted by scrapers 19, 15 and brushes 18 located at a distance from each other, these cleaning members extend over the entire length of the wiping roller 1 and act on its periphery to remove the major part of the ink mechanically from the periphery of this roller and on the other hand, rows of nozzles 31, 32, 33, 34, 35, 36 parallel to the axis of the wiping roller in order to eject a cleaning liquid, for example an alkaline aqueous solution, onto the periphery of the roller in front of the area of contact of the scrapers 19, 15 or brushes 18 with the wiping roller 1.

On the two inner walls of the container 3, corresponding to the two front surfaces of the wiping roller 1, two curved rails 4 spaced axially of the wiping cylinder (only one of which is shown in FIG. 1) are arranged coaxially with respect to the roller 1 and mounted between guide rollers 7, which are mounted to rotate on the walls of the container and slide along the arc of a circle defined by the rails, concentrically with respect to the shaft 1*a* of the roller. Curved racks 5, fixed to one side of the guide rails 4, mesh respectively with a toothed wheel 6, said toothed wheels being fixed to the ends of a shaft 6*a* arranged to the shaft 1*a* of the wiping roller. Through the intermediary of a mechanism comprising an endless screw or by means of a ram (not shown) the shaft 6*a* may rotate on the outside, in the direction of the arrow F3, which facilitates the reciprocating movement of the racks 5 in opposite directions as illustrated by the double arrow F2. Fixed to the rails 4, by cotter pins, are each of the ends of coil springs 8 whose axes follow the shape of the rail 4 at least approximately. Pivoted to the other ends of the coil springs not connected to the rail 4, by means of cotter pins, are control arms 9,10, which rest respectively at the two ends of shafts 11, 12 parallel to the shaft 1*a* of the wiping roller 1. These shafts are mounted on each side of a recess in the shape of a half circle, open in the direction of the wiping roller 1, in a common support plate 13 fixed to one or other of the walls of the container. A scraper support 14 provided with a removable doctor blade 15 of steel sheet rest respectively on each of the shafts 11. A brush-support 17 comprising a removable brush 18 fixed by means of screws (not shown), is fixed to the shaft 12. The cleaning members, brushes or scraper blades, are thus easily interchangeable without it being necessary to dismantle the supports or shafts.

The scrapers 15 and the brush 18 extend over the entire length of the wiping roller 1 and act on its periphery, during operation, with a predetermined pressure which may be regulated by moving the rails 4 through the intermediary of the shaft 6*a*. Since the control arms 9, 10 are suspended by means of coil springs 8 on the rails 4, these springs exert pressure and the doctors and brush are in flexible elastic contact against the wiping roller.

The peripheral area of the wiping roller 1 firstly comes into contact with a first scraper 19 connected to a regulating system which makes it possible to move the latter automatically away from the periphery of the roller and to rest the latter thereon automatically at the time of starting up the latter. The scraper 19 is made from steel sheet and its support 20 rests on a shaft 21 mounted to rotate in bearings.

Fixed to one of the ends of the shaft 21 is a control arm 23 pivoted by a pivot 24 on the head 25 of a hydraulic piston 26, which may be actuated by means of a hydraulic cylinder 27 able to move about a pivot 28. Two hydraulic devices, which may be operated simultaneously, are also arranged for the rotation of the shaft 21 on the two sides of the container. In the operating position, the piston 26 is in the suspended position, such that the scraper 19 is pressed against the wiping roller, at the predetermined pressure.

A first row of nozzles 31 is located in front of the area of contact of the first scraper 19 and the wiping roller, which row of nozzles is fixed to the wall of the container 3 and the direction of whose orifices is approximately towards said area of contact, these nozzles making it possible to wet the wiping roller with a continuous film of cleaning liquid.

The first scraper 19 constituting the first cleaning member forms, according to FIG. 1, an acute angle with the peripheral segment of the latter located after the scraper with respect to the direction of rotation of the roller. This first scraper 19 removes approximately 95% of the mass of ink adhering to the surface of the wiping roller and in order that the particles of ink do not accumulate behind this scraper 19, a second row of nozzles 32 is mounted on the first scraper-support 20 behind said scraper 19 and such that the orifices of the nozzles are directed inside said acute angle, towards the region of contact of the scraper with the wiping roller.

As shown in FIG. 1, in the operating position, the other scrapers 15 form acute angles with the periphery of the wiping roller 1 located in front of said scrapers with respect to the direction of rotation of the wiping roller. The other rows of nozzles 33, 34, 35, 36 are mounted on the scraper-supports 14, respectively brush-supports 17, in front of the scrapers 15, respectively brush 18 and such that the orifices of the nozzles are directed inside said acute angles towards the region of contact of said scrapers, respectively said brush.

As mentioned above, in view of the fact that the area of the wiping roller 1 located between the first scraper 19 and the second scraper 15 is already wetted by the second row of nozzles 32, it is quite possible to eliminate the row of nozzles 33 associated with the second scraper 15.

Figure 2:
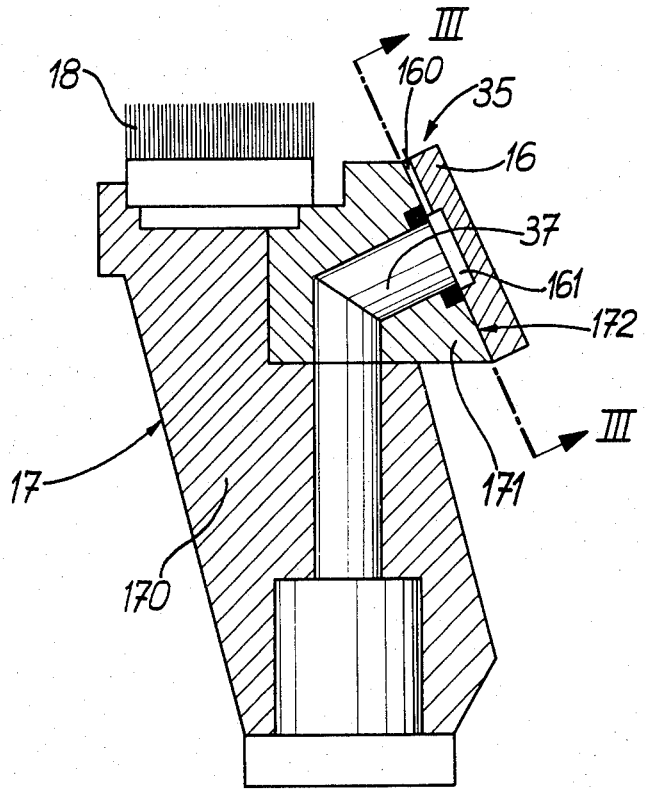
FIG. 2 is an enlarged diagrammatic cross section view of a brush-support with a supply for spray nozzles.
Figure 3:
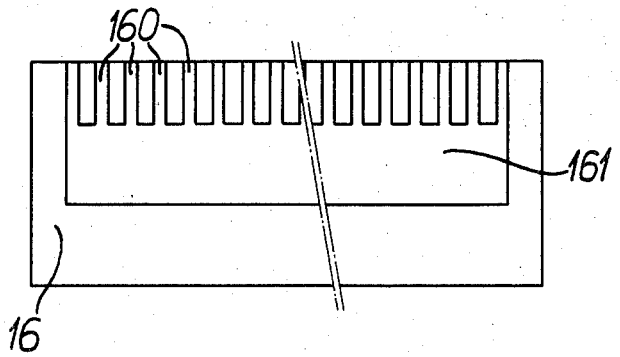
FIG. 3 is a diagrammatic view of part of the support taken on section line III—III of FIG. 2.

FIGS. 2 and 3 show one embodiment of the spray nozzles associated with the brush-support 17, the construction of the spray nozzles associated with the various scraper-supports is identical. The brush-support 17, which has an elongated shape and which is parallel to the axis of rotation of the wiping roller 1 is formed of two complementary parts 170,171, one part 170 forming the brush-support or support proper which rests on the shaft 12, whereas the other part 171 serves as a partial support for the brush 18, which is fixed for example by screws (not shown), this part 171 also comprising the spray nozzles 35. These spray nozzles 35 are formed by a plate 16 pressed against a wall 172 of the part 171 of the support and provided on the upper half of its face in contact with the support, with several parallel grooves 160 interconnected by a main groove 161 at right-angles thereto and into which opens the channel 37 for supplying the cleaning liquid. The grooves 160 are small, very numerous and close together in order that the cleaning liquid is sprayed as a continuous film of liquid. The wall 172 of the support is inclined with respect to the vertical such that the ejection direction of the nozzles is directed into the acute angle formed between the brush 18 and the wiping roller. All the supports for the cleaning members, scraper-support 14 or brush-support 17, which comprise spray nozzles in their configuration, apart from the first support 20 of the first scraper 19, may be designed in the same way, for reasons of economy. However, in order to obtain an approximately constant pressure of the cleaning liquid on the surface of the roller, at any point of the roller, it is also possible to provide that the ejection direction of the rows of nozzles 33, 34, 35, 36 forms an approximately constant angle with respect to the vertical. However, it is appropriate if all the jets are inclined with respect to the vertical so as not to require too great a supply pressure of the cleaning liquid.

All the rows of nozzles 31, 33, 34, 35, 36, with the exception of the second 32, are connected to the outlet of a single pump P1, which supplies them with clean cleaning liquid, coming from a source 38, through the intermediary of a main pipe 39 and a distributor 40.

The second row of nozzles 32 associated with the first scraper 19 is connected to a pump P2 which is supplied with the liquid already used, which flows through an outlet orifice 41 in the container 3.

By this means, it is thus possible that the pump P2 has the high rate of flow and high pressure necessary for the supply of the second row of nozzles 32, whereas in order to supply all the other rows of nozzles 31, 33, 34, 35, 36 having a lower rate of flow and lower liquid pressure, it is sufficient to have a common pump P1. All these rows of nozzles 31, 33, 34, 35, 36 which are supplied with a clean solution, may have very thin outlet orifices, since there is no danger of blockage by impurities. It is also preferable that the first row of nozzles 31 is also supplied with a clean solution, in order that the quantity of solution coming from the nozzles 33 to 36 is sufficient to be re-used with a high rate of flow and high pressure for supplying solely the second row of nozzles 32 through the intermediary of the pump P2.

In order not to mix the very dirty liquid resulting from cleaning of the roller by the first two rows of nozzles 31 and 32 and the first scraper 19 with that coming from the other rows of nozzles, the container 3 is divided by a wall 42 into two compartments 3*a*, 3*b*. The first compartment 3*a* is located below the scraper 19 constituting the first cleaning member. This compartment which thus receives the dirtiest liquid is provided with a flow orifice 43, through which the used liquid is evacuated. The second compartment 3*b* is located below the other cleaning members and is provided, as above-mentioned, with the outlet orifice 41 connected to the pump P2.

The walls of the container which define the first compartment 3*a* are provided with several ejection orifices 44 connected to a source of water and intended to be actuated at predetermined time intervals in order to clean the walls of this compartment 3*a*, which become dirty very quickly owing to the deposition of ink.

At least the bottom of the compartment 3*b* of the container 3, which is preferably formed by an inclined wall 45, is covered with sheets of polished stainless steel.

After all the cleaning members and nozzles, a flexible scraper 29 is preferably provided, fixed to a support 30 and which may be advantageously made of polytetrafluoroethylene, this scraper 29 in contact with the wiping roller making it possible to eliminate any film of liquid remaining on the periphery of this roller.

The embodiment which has been described may be adapted to numerous variations, in particular as regards the choice of the number of cleaning members and their shape, the number of rows of nozzles and their arrangement.

It may also be particularly advantageous to provide, after the first scraper 19, another scraper 15 which constitutes the second cleaning member, whereas the three following cleaning members are constituted by brushes.

What is claimed is:

1. In a printing apparatus having a rotatable wiping cylinder and a receptacle for cleaning fluid, the receptacle being arranged to receive a portion of the periphery of the wiping cylinder without the wiping cylinder dipping into cleaning fluid within the receptacle, a plurality of cleaning members in said receptacle arranged below the axis of the wiping cylinder spaced downstream in the direction of rotation of the wiping cylinder and disposed for engaging the periphery of the wiping cylinder, and a plurality of rows of nozzles disposed along each of said cleaning members upstream thereof in said direction of rotation for each continuously wetting the periphery of said wiping cylinder with cleaning fluid at each corresponding zone of contact of each corresponding cleaning member with said periphery of the wiping cylinder, means to supply cleaning fluid to said nozzles, a main cleaning scraper in said plurality of cleaning members disposed for engaging the periphery of the wiping cylinder upstream of said plurality of cleaning members relative the direction of rotation of the wiping cylinder, the main cleaning scraper subtending an acute angle with the periphery of the wiping cylinder located downstream of the main cleaning scraper in the direction of rotation of the wiping cylinder, the nozzles of a row of nozzles between the main cleaning scraper and a cleaning member of said plurality immediately downstream of said main cleaning scraper having orifices for directing cleaning fluid in the direction of the apex of said acute angle, and a row of nozzles upstream of said main cleaning scraper for directing cleaning fluid in the direction of said acute angle.

2. In a printing apparatus according to claim 1, including means to supply a clean cleaning fluid to said nozzles.

3. In a printing apparatus according to claim 1, in which a direction of ejection of said nozzles subtends an angle with respect to the vertical.

4. In a printing apparatus according to claim 1, in which said means to supply said clean cleaning fluid supplies cleaning fluid to one of said rows of nozzles at a greater rate of flow than the other rows of nozzles.

5. In a printing apparatus according to claim 1, including means to vary the direction of ejection of at least some of the rows of nozzles.

6. In a printing apparatus according to claim 1, including a pump to provide the cleaning fluid to said row of nozzles having orifices directing cleaning fluid separately from the remainder of said nozzles.

7. In a printing apparatus according to claim 6, including another pump providing cleaning fluid to said remainder of said nozzles.

8. In a printing apparatus according to claim 1, including an upstanding partition in said receptacle dividing the receptacle into two separate spaces, a first space for receiving dirty cleaning fluid from said wiping cylinder from the vicinity of said rows of nozzles other than the last two mentioned rows of nozzles, and a pump for taking cleaning fluid from said first space and applying it to said nozzles having said orifices.

* * * * *